United States Patent [19]

Mertens et al.

[11] Patent Number: 5,033,492

[45] Date of Patent: Jul. 23, 1991

[54] RINSING APPARATUS FOR CONTAINERS

[76] Inventors: Darrell W. Mertens, 12376 Rd. 27; Alfred C. Graves, 1816 Pheasant Ridge, both of Sterling, Colo. 80751

[21] Appl. No.: 253,575

[22] Filed: Dec. 20, 1989

[51] Int. Cl.[5] ..... B08B 9/08

[52] U.S. Cl. ..... 134/166 R; 134/182; 141/59; 141/92; 366/174; 239/124

[58] Field of Search ..... 134/166 R, 169 R, 182, 134/183, 198, 200; 239/123, 124, 125, 126, 127, 370, 371; 222/318; 137/212, 588; 141/59, 65, 92; 366/173, 174, 178, 337, 139; 15/302, 304, 409

[56] References Cited

U.S. PATENT DOCUMENTS

| | | | |
|---|---|---|---|
| 519,513 | 5/1894 | Torchiani | 137/588 X |
| 2,169,514 | 8/1939 | Buzzard et al. | 239/127 X |
| 3,263,711 | 8/1966 | Laub | 141/59 X |
| 3,268,212 | 8/1966 | Ziselberger | 366/178 X |
| 3,916,924 | 11/1975 | McGowan | 134/95 |
| 3,969,608 | 7/1976 | Day | 239/127 X |
| 4,119,114 | 10/1978 | Bolton et al. | 137/318 |
| 4,144,901 | 3/1979 | Steverson | 137/240 |
| 4,162,745 | 7/1979 | Anderosn, Jr. | 222/148 |
| 4,386,637 | 6/1983 | Buchnan et al. | 141/65 |

*Primary Examiner*—Philip R. Coe

*Attorney, Agent, or Firm*—Leydig, Voit & Mayer

[57] ABSTRACT

A rinsing apparatus for containers has concentric inner and outer pipes which are loosely nested in one another. A passageway for a rinsing fluid is formed between the two pipes. An inlet which is formed in the outer pipe enables a rinsing fluid to be introduced into the passageway from the outside of the outer pipe. One end of the outer pipe is equipped with a seal member which prevents rinsing fluid from flowing out of the passageway through the one end. The other end of the outer pipe can be equipped with a deflector which surrounds the inner pipe and deflects rinsing fluid flowing through the passageway outwards.

18 Claims, 2 Drawing Sheets

RINSING APPARATUS FOR CONTAINERS

BACKGROUND OF THE INVENTION

This invention relates to an apparatus for rinsing out the insides of containers for holding liquids. More particularly but not exclusively, it relates to an apparatus for rinsing out empty drums for agricultural pesticides and water-soluble industrial fluids.

Agricultural pesticides are typically sold in metal drums which range in size from 30 up to 100 gallons. When a drum for pesticides has become empty, before it can be discarded in a landfill or transported without compliance with regulations on hazardous materials, government regulations require that the inside of the drum be thoroughly rinsed (usually three times) so as to remove all remaining pesticides.

A number of devices have been proposed for automatically rinsing out empty containers for pesticides. These devices generally employ concentric inner and outer pipes. A rinsing fluid such as water is introduced into the container through the outer pipe and sprayed against the inner surfaces of the container, while pesticide and the rinsing fluid are removed from the container via the inner pipe.

However, conventional rinsing devices have a complicated structure, and in particular they have a complex seal arrangement which makes them expensive to manufacture and repair.

SUMMARY OF THE INVENTION

Accordingly, it is an object of the present invention to provide a rinsing apparatus for containers which is easy and inexpensive to manufacture and repair.

It is another object of the present invention to provide a rinsing apparatus for containers which is easy to adjust for use with containers of different heights.

It is yet another object of the present invention to provide a rinsing apparatus for containers which can be assembled and repaired by the user of the apparatus.

It is still another object of the present invention to provide a rinsing apparatus for containers which can clean itself during use.

A rinsing apparatus according to the present invention includes an inner pipe and an outer pipe which loosely surrounds the inner pipe so that a passageway for a rinsing fluid is formed between the two pipes. An inlet which is formed in the outer pipe enables a rinsing fluid to be introduced into the passageway from the outside of the outer pipe. One end of the outer pipe is equipped with a single seal member which prevents rinsing fluid from flowing out of the passageway through the one end. The other end of the outer pipe can be equipped with a deflector which surrounds the inner pipe and deflects rinsing fluid flowing through the passageway to the outside of the outer pipe.

Preferably, there is a gap between the deflector and the inner pipe so that a rinsing fluid can flow through the gap and rinse the outer surface of the inner pipe.

The seal member is preferably an O-ring which is disposed between the inner and outer pipes. A packing nut may be provided for exerting an adjustable compressive force on the O-ring so as to adjust the tightness of the seal formed by the O-ring. Only a single seal member is necessary between the inner and outer pipes, so the apparatus of the present invention is easy and inexpensive to manufacture and assemble.

The inner and outer pipes need not have any particular cross-sectional shape, but for economy, they are preferably formed from cylindrical pipe stock.

DESCRIPTION OF THE PREFERRED EMBODIMENT

Figure 1:
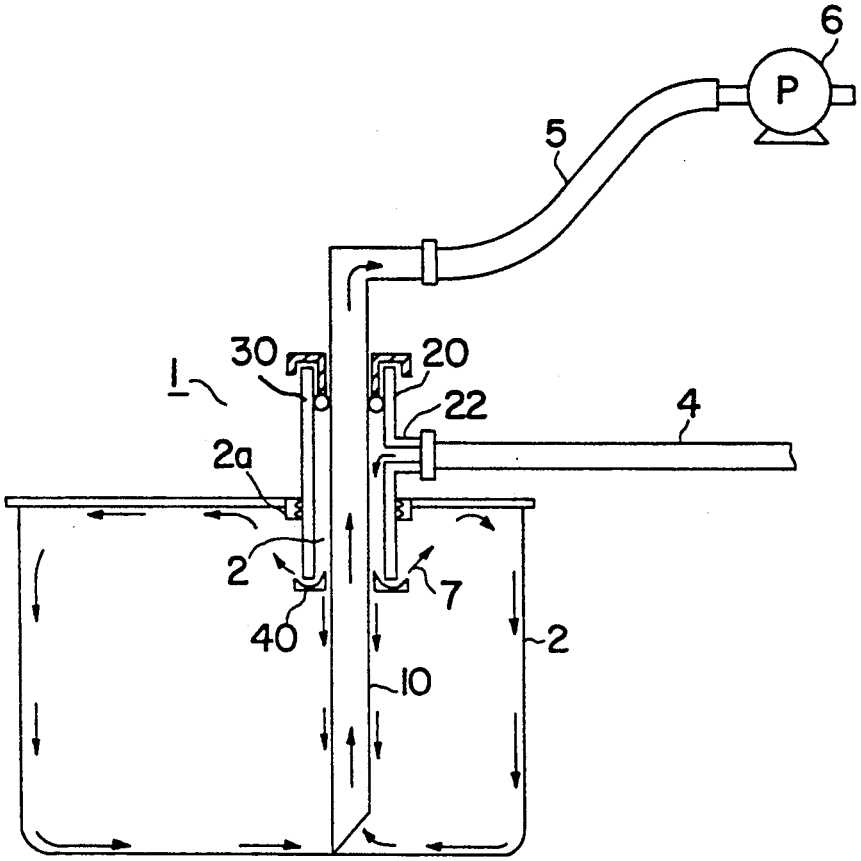
FIG. 1 is a cross-sectional view of an embodiment of a rinsing apparatus according to the present invention as mounted on a 55-gallon drum.

A preferred embodiment of a rinsing apparatus according to the present invention will now be described while referring to the accompanying drawings. FIG. 1 illustrates this embodiment as mounted on a 55-gallon drum 2 for pesticides. The rinsing apparatus, indicated by reference numeral 1, includes an inner pipe 10 and a concentric outer pipe 20 which extends through the center of the inner pipe 10. The upper end of the inner pipe 10 is connected to a pump 6 by a hose 5, while the lower end of the inner pipe 10 rests on the bottom of the drum 2. The lower end of the inner pipe 10 may be bevelled or crenelated to prevent the bottom of the drum 2 from obstructing the flow of liquid into the inner pipe 10. The inner pipe 10 serves as a suction probe for withdrawing liquid from the drum 2.

The outer pipe 20 fits loosely around the inner pipe 10 so that a passageway 21 for a rinsing fluid 7 is formed between the two pipes. A hollow nipple 22 extends from the outer surface of the outer pipe 20. The hollow center of the nipple 22 communicates with the passageway 21. The outer end of the nipple 22 is connected to an unillustrated source of rinsing fluid 7 by a hose 4. When the drum 2 contains pesticides, the rinsing fluid 7 is typically water, but it can be any fluid which can dissolve the liquid which is contained inside the drum 2.

The upper end of the outer pipe 20 is equipped with a single seal member 30, which can be in the form of an O-ring 31 which forms a seal between the inner pipe 10 and the outer pipe 20 and prevents rinsing fluid 7 from leaking from the upper end of the outer pipe 20. The lower end of the outer pipe 20 is equipped with a deflector in the form of an annular deflecting ring 40 which loosely surrounds the inner pipe 10. The upper surface of the deflecting ring 40 has an indented deflecting surface 41. Rinsing fluid 7 flowing downwards through the passageway 21 strikes the deflecting surface 41 and is deflected outwards from the deflecting ring 40 towards the top and sides of the inside of the drum 2.

The outer pipe 20 extends through and is mounted in a hole in the top of the drum 2, with the nipple 22 located on the outside and the deflecting ring 40 located on the inside of the drum 2. Any suitable means can be used to mount the outer pipe 20 on the drum 2. If the drum 2 is equipped with an internally threaded bung hole 2, as is typical of pesticide drums, the outer surface of the outer pipe 20 can be equipped with external threads 25 which engage with the internal threads of the bung hole **2*a* and form a seal between the outer pipe 20 and the bung hole 2*a***.

Figure 2:
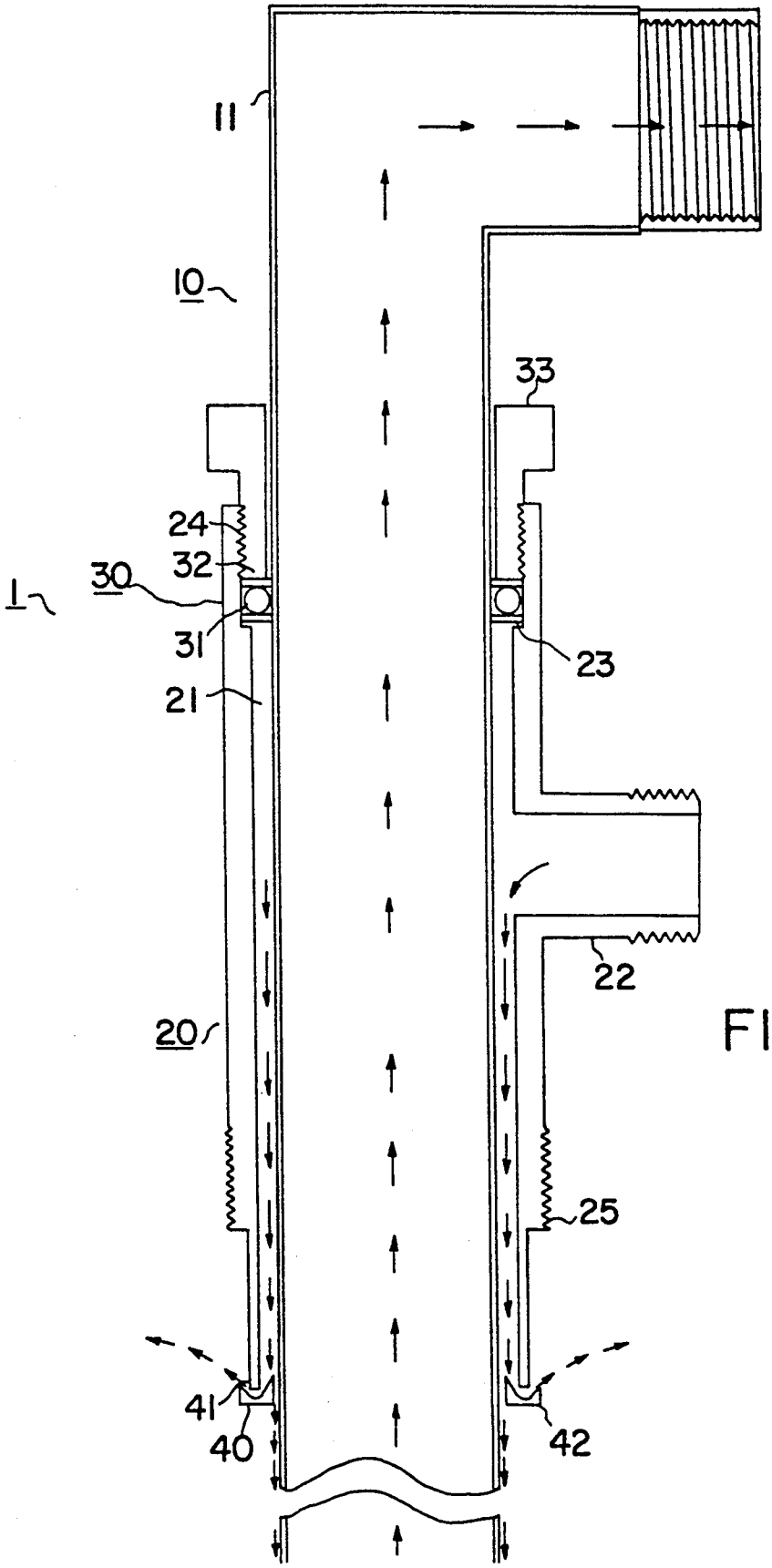
FIG. 2 is an enlarged cross-sectional view of the upper portion of the embodiment of FIG. 1.

FIG. 2 illustrates the structure of the embodiment of FIG. 1 in greater detail. An elbow 11 is formed on the upper end of the inner pipe 10. The outer end of the elbow 11 can be threaded to enable the elbow 11 to be connected to hose 5 by a conventional threaded hose connector. Similarly, the outer end of the nipple 22 on the outer pipe 20 can be threaded so that it can be connected to hose 4 by a conventional screw-on connector.

One of the advantages of the present invention is that a very simple seal member 30 in the form of a single O-ring 31 can be employed to form a seal between the inner and outer pipes. The O-ring 31 rests on a ledge 23 formed in the inner surface of the upper end of the outer pipe 20. Back-up rings 32 are disposed on opposite sides of the O-ring 31. The O-ring 31 is held in place on the ledge 23 by a packing nut 33 which screws into threads 24 formed at the upper end of the outer pipe 20. The lower surface of the packing nut 33 contacts the upper back-up ring 32 and exerts a compressive force on the O-ring 31. The tightness of the seal formed by the O-ring 31 between the inner and outer pipes can be adjusted by varying the compressive force exerted by the packing nut 33 on the O-ring 31. When it is desired to raise or lower the inner pipe 10 with respect to the outer pipe 20, the packing nut 33 can be loosened to reduce the compressive force acting on the O-ring 31 and thereby reduce the frictional force between the O-ring 31 and the inner pipe 10 to allow the inner pipe 10 to be moved longitudinally with respect to the outer pipe 20. When the inner pipe 10 has been moved to the proper height, the packing nut 33 can be tightened to compress the O-ring 31 until a reliable seal is formed between the inner and outer pipes which will prevent rinsing fluid 7 from leaking from the upper end of the outer pipe 20.

External pipe threads 25 are formed on the outer pipe 20 beneath the nipple 22 to enable the outer pipe 20 to be screwed into the bung hole 2*a* of a drum 2. The section of the outer pipe 20 below the outer threads 25 has a smaller outer diameter than the outer threads 25. The deflecting ring 40 is secured to the bottom end of the outer pipe 20. The indented deflecting surface 41 of the deflecting ring 40 is separated from the bottom end of the outer pipe 20 by one or more gaps 42 which extend in the circumferential direction of the deflecting ring 40. The deflecting surface 41 guides rinsing fluid 7 from inside the passageway 21 through the gaps 42 between the deflecting ring 40 and the outer pipe 20 and sprays the rinsing fluid 7 outwards against the inner surface of the drum 2. The deflecting ring 40 fits loosely around the inner pipe 10 so that rinsing fluid 7 can flow along the outer surface of the inner pipe 10 between the inner pipe 10 and the deflecting ring 40. The deflecting ring 40 can be secured to the bottom end of the outer pipe 20 by any suitable method which will leave gaps 42 between the two. For example, the deflecting ring 40 can be welded to the bottom of the outer pipe 20 at a plurality of locations. However, it may be desirable to attach the deflecting ring 40 by means of bolts or other means which allows the deflecting ring 40 to be easily replaced. The outer diameter of the deflecting ring 40 should be small enough for the deflecting ring 40 to pass through the bung hole 2*a* in a drum 2.

Figure 3:
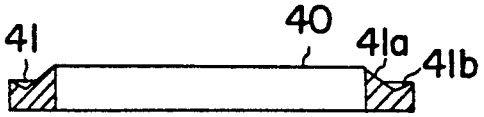
FIG. 3 is a cross-sectional view of the deflector ring of FIG. 2.

FIG. 3 is a cross-sectional view of an example of a deflecting ring 40 for use in the present invention. The deflecting ring 40 has an indented deflecting surface 41 with an inner sloped surface 41*a* and an outer sloped surface 41*b* which slope towards one another, the inner sloped surface 41*a* being located radially inwards of the outer sloped surface 41*b*. In the illustrated example, the slope of the inner sloped surface 41*a* with respect to the bottom surface of the deflecting ring 40 is greater than the slope of the outer sloped surface 41*b*. The angles of slope are not critical, but an example of angles which have been found to be suitable are a uniform slope of 45 degrees for the inner sloped surface 41*a* and a uniform slope of 12 degrees for the outer sloped surface 41*b*. However, the slopes of the surfaces need not be nonuniform or straight. For example, it is possible for the deflecting surface 41 to be concave.

Instead of employing a deflecting ring 40, it is possible to cut slits in the bottom end of the outer pipe 20 for the discharge of the rinsing fluid 7. However, a deflecting ring is superior to slits in that a deflecting ring is easier and less expensive to manufacture and does not decrease the structural strength of the outer pipe 20 as slits do.

There are no special restrictions on the materials which can be employed for the present invention. When durability and corrosion resistance are desired, the inner and outer pipes, the packing nut 33, and the deflecting ring 40 are preferably made of a material such as stainless steel. However, when strength is not important, a plastic material such as PVC piping can instead by employed. Since none of the elements of the apparatus of the present invention requires careful machining for a close fit, the workability of the materials is not an important consideration.

The embodiment of FIGS. 1 and 2 can be used both to remove a liquid, such as pesticide, from a drum 2 and then to rinse out the drum 2 when it has been emptied. In order to remove pesticide from a drum 2, the lower ends of the inner and outer pipes are inserted into the bung hole 2*a* of a drum 2, and the external threads 25 of the outer pipe 20 are screwed into the bung hole 2*a*. With the packing nut 33 loosened so that it does not compress the O-ring 31, the inner pipe 10 is slid downwards inside the outer pipe 20 until its bottom end rests on the bottom of the drum 2. The packing nut 33 is then tightened to compress the O-ring 31 and form a tight seal. The elbow 11 of the inner pipe 10 is connected to the pump 6 by hose 5. When removing pesticide from the drum 2, the nipple 22 of the outer pipe 20 is preferably left open to the atmosphere to allow air to enter the drum 2. The pump 6 is then operated to withdraw pesticide from the drum 2 via the inner pipe 10.

When the drum 2 has been substantially emptied, the pump 6 is stopped and hose 4 is connected to the nipple 22. Rinsing fluid 7 under pressure is then supplied to the nipple 22 from the unillustrated source of rinsing fluid 7. When rinsing fluid 7 reaches the nipple 22, the pump 6 can be turned on again. Rinsing fluid 7 from hose 4 enters the passageway 21 between the inner and outer pipes as shown by the arrows in FIG. 2 and flows downwards. A small portion of the rinsing fluid 7 flows downwards through the gap between the deflecting ring 40 and the inner pipe 10 and rinses the outer surface of the inner pipe 10. However, most of the rinsing fluid 7 is deflected by the deflecting ring 40. The shape of the deflecting surface 41 is such that the rinsing fluid 7 is sprayed both upwards and outwards so as to strike both the top and the upper sides of the drum 2. As the deflecting ring 40 extends entirely around the outer pipe 20, rising fluid 7 is sprayed in all directions at once against the inner surface of the drum 2. The spray of rinsing fluid 7 rinses pesticide off the inner surface of the drum 2. The rinsing fluid 7 and pesticide then flow downwards to the bottom of the drum 2, from where they are sucked into the inner pipe 10 and then discharged from the drum 2, as shown by the arrows in FIG. 2.

The rate at which the rinsing fluid 7 is introduced into the outer pipe 20 is not critical and is determined by the capacity of the pump 6. Fluid should be introduced through the nipple 22 no more slowly than fluid is withdrawn from the drum 2 by the pump 6 to prevent the creation of a vacuum which could cause the drum 2 to collapse. A pressure on the order of 30 psi and a flow rate of 6–10 gallons per minute is adequate to thoroughly flush the inside of a container. Therefore, a water faucet can be employed as the source of rinsing fluid 7, and a usual garden hose can be used to supply the rinsing fluid 7 to the nipple 22.

As mentioned earlier, the rinsing fluid 7 which flows downwards through the gap between the deflecting ring 40 and the inner pipe 10 automatically cleans off the outside of the inner pipe 10. Furthermore, the spray of rinsing fluid 7 from the deflecting ring 40 rinses off those portions of the outer pipe 20 situated inside the drum 2. Therefore, the apparatus of the present invention is self-cleaning, and after it has been used to rinse out a drum, it does not require any further cleaning.

When the O-ring 31 wears out, it can easily replaced by unscrewing the packing nut 33, withdrawing the inner pipe 10 from the outer pipe 20, and inserting a new O-ring 31 in place of the old one.

The present invention has been described with respect to its use for rinsing drums for pesticides. However, it is not restricted to use with any particular type or size of container. For example, it can be used to rinse containers for various types of industrial chemicals.

What is claimed is:

1. A rinsing apparatus for a container comprising:
an inner pipe;
an outer pipe which loosely surrounds the inner pipe and defines a passageway for liquid between the inner and outer pipes, the outer pipe having a downstream end through which the inner pipe extends;
a seal member which forms a seal between the inner and outer pipes;
an inlet which is formed in the outer pipe between the seal member and the downstream end of the outer pipe and which opens onto the passageway; and
a deflector which is disposed at the downstream end of the outer pipe and within the container and which has a deflecting surface for deflecting a liquid in the passageway away from the outer pipe, whereby the deflected liquid rinses the inside walls of the container.

2. A rinsing apparatus as claimed in claim 1 wherein the deflector comprises a ring which loosely surrounds the inner pipe.

3. A rinsing apparatus as claimed in claim 2 wherein the deflecting surface is an indented surface which is separated from the downstream end of the outer pipe by a gap.

4. A rinsing apparatus as claimed in claim 3 wherein the deflecting surface is shaped so as to deflect liquid upwards and away from the outer pipe.

5. A rinsing apparatus as claimed in claim 2 wherein the ring is substantially flat and has first and second opposite sides and the deflecting surface is formed on one of the sides.

6. A rinsing apparatus as claimed in claim 1, further comprising seal adjusting means for adjusting the tightness of the seal formed by the seal member between the inner and outer pipes.

7. A rinsing apparatus as claimed in claim 6 wherein the seal member comprises an O-ring which is disposed between the inner and outer pipes, and the seal adjusting means comprises means for exerting a variable compressive force on the O-ring.

8. A rinsing apparatus as claimed in claim 7 wherein the means for exerting a variable compressive force on the O-ring comprises a nut which engages with the outer pipe and which has a surface for exerting a compressive force on the O-ring.

9. A rinsing apparatus as claimed in claim 8 wherein: the O-ring seal member rests on a ledge on the interior of the outer pipe.

10. A rinsing apparatus as claimed in claim 1 further comprising external threads formed on the outer surface of the outer pipe for connecting the outer pipe to a bung hole of a container.

11. A rinsing apparatus as claimed in claim 1 wherein the deflector is secured to the downstream end of the outer pipe.

12. A rinsing apparatus as claimed in claim 1 wherein the outer pipe has an axis extending parallel to the passageway for liquid and the deflecting surface is shaped to deflect liquid in the passageway away from the axis of the outer pipe.

13. A rinsing apparatus as claimed in claim 1 wherein the deflector comprises a ring extending across and substantially blocking the downstream end of the outer pipe and having an opening through which the inner pipe passes.

14. A rinsing apparatus for a container comprising:
an inner pipe;
an outer pipe which loosely surrounds the inner pipe and defines a passageway for liquid between the inner and outer pipes, the outer pipe having a downstream end through which the inner pipe extends;
an O-ring which is mounted in the passageway and forms a seal between the inner and outer pipes;
a packing nut which is screwed onto the outer pipe adjacent to the O-ring and which has a surface for exerting a compressive force on the O-ring when the packing nut is rotated in a prescribed direction;
a nipple which is formed in the outer pipe between the O-ring and the downstream end of the outer pipe and which opens onto the passageway;
a deflecting ring which is disposed at the downstream end of the outer pipe, which loosely surrounds the inner pipe, and which has an indented deflecting surface for deflecting a liquid in the passageway away from the outer pipe; and
external threads formed on the outer surface of the outer pipe for connecting the outer pipe to a bung hole of a container.

15. A rinsing apparatus for a container comprising:
an inner pipe;
an outer pipe which loosely surrounds the inner pipe and defines a passageway for liquid between the inner and outer pipes, the outer pipe having a downstream end through which the inner pipe extends;
no more than one elastic seal member which forms a liquid-tight seal between the inner and outer pipes and forms an end of the passageway for liquid, the passageway having constant dimensions between the seal member and the downstream end of the outer pipe;

an inlet which is formed in the outer pipe between the seal member and the downstream end of the outer pipe and which opens onto the passageway; and a discharge opening for liquid at the downstream end of the outer pipe and within the container, whereby liquid rinses the inside walls of the container.

16. A rinsing apparatus as claimed in claim 15 further comprising seal adjusting means for adjusting the tightness of the seal formed by the seal member between the inner and outer pipes.

17. A rinsing apparatus as claimed in claim 16 wherein the seal member comprises an O-ring which is disposed between the inner and outer pipes, and the seal adjusting means comprises means for exerting a variable compressive force on the O-ring.

18. A rinsing apparatus as claimed in claim 15 further comprising a deflector which is connected to the downstream end of the outer pipe and which has a deflecting surface for deflecting a liquid in the passageway away from the outer pipe, wherein the discharge opening comprises a gap between the downstream end of the outer pipe and the deflecting surface.

* * * * *